US006604656B1

(12) United States Patent
Tseng

(10) Patent No.: US 6,604,656 B1
(45) Date of Patent: Aug. 12, 2003

(54) SAFETY LOCK RING STRUCTURE OF A DISPENSER PUMP

(75) Inventor: Kun-Lung Tseng, Taichung Hsien (TW)

(73) Assignee: Living Fountain Plastic Industrial Co., Ltd., Taichung (TW)

( * ) Notice: Subject to any disclaimer, the term of this patent is extended or adjusted under 35 U.S.C. 154(b) by 0 days.

(21) Appl. No.: 10/071,661

(22) Filed: Feb. 11, 2002

(51) Int. Cl.[7] ..... B67D 5/33

(52) U.S. Cl. ..... 222/153.13; 222/321.9; 222/384

(58) Field of Search ..... 222/153.13, 383.1, 222/321.9, 384

(56) References Cited

U.S. PATENT DOCUMENTS 4,479,589 A * 10/1984 Ford ..... 222/153.13
5,549,223 A * 8/1996 Hori ..... 222/384

* cited by examiner

*Primary Examiner*—Philippe Derakshani
(74) *Attorney, Agent, or Firm*—Harrison & Egbert

(57) ABSTRACT

A dispenser pump is provided with a pump head and a locking cap fastened to the pump head. The pump head and locking cap are provided with a ratchet portion to prevent the pump head from being disengaged from the locking cap accidentally or inadvertently. The ratchet portion can be twisted off to facilitate the disengaging of the pump head with the locking cap, so as to enable the dispenser pump.

1 Claim, 8 Drawing Sheets

SAFETY LOCK RING STRUCTURE OF A DISPENSER PUMP

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a dispenser pump, and more particularly to a safety lock ring structure of the dispenser pump.

BACKGROUND OF THE INVENTION

As shown in FIGS. 1 and 2, a dispenser pump 10 of the prior art is provided at the bottom with a piston rod 11 extending through a cap 20 into a cylindrical body 30 to urge one end of a spring 31. The spring 31 serves to provide the piston rod 11 with a recovery force. The cylindrical body 30 is provided therein with a slot 32 and a check ball 33 which is retained in the slot 32. As the dispenser pump 10 is exerted on by an external force, the contents of the cylindrical body 30 are dispensed. In view of the fact that the dispenser pump 10 is apt to be exerted on by the external force accidentally or inadvertently, the cylindrical body 30 is provided at the top end with a fastening cap 21 which is provided with inner threads 22. In the meantime, the piston rod 11 of the dispenser pump 10 is provided at the top segment thereof with outer threads 12 engageable with the inner threads 22. The piston rod 11 is locked by the fastening cap 21 such that the outer threads 12 of the piston rod 11 are engaged with the inner threads 22 of the fastening cap 21, thereby preventing the contents of the cylindrical body 30 from being dispensed by accident. However, if the dispenser pump 10 is inadvertently turned in reverse, the inner threads 22 of the fastening cap 21 become disengaged with the outer threads 12 of the piston rod 11, as shown in FIG. 2;

BRIEF SUMMARY OF THE INVENTION

The primary objective of the present invention is to provide a dispenser pump with a safety structure for preventing the contents of the dispenser from being dispensed accidentally or inadvertently.

In keeping with the principle of the present invention, the foregoing objective of the present invention is attained by a dispenser pump safety structure comprising a dispenser pump head, a locking cap, and a twist-off means to avert the disengagement of the locking cap with the dispenser pump head, thereby preventing the contents of the dispenser from being dispensed accidentally or inadvertently.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
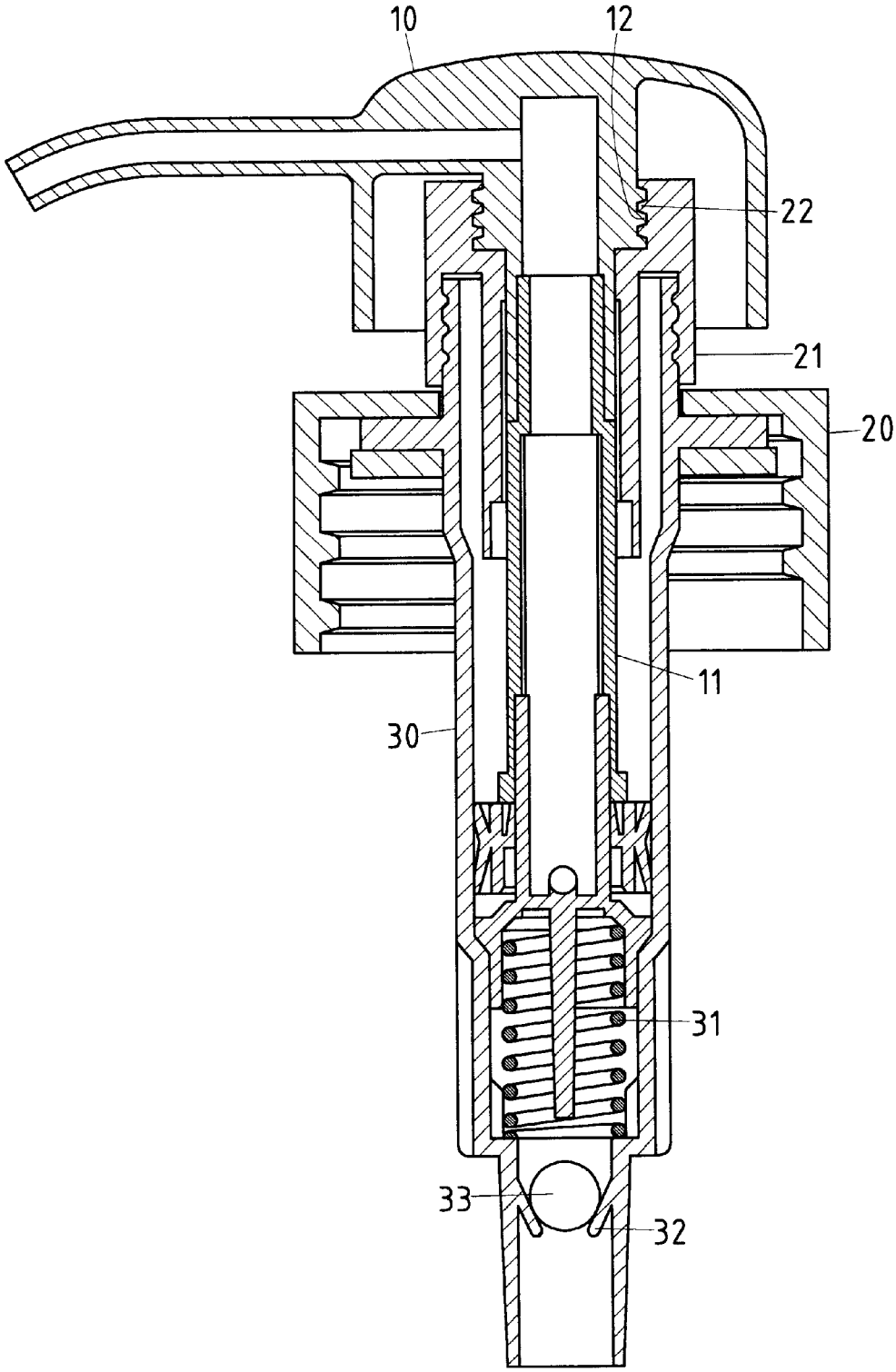
FIG.1 PRIOR ART
FIG. 1 shows a longitudinal sectional view of the engagement of the fastening cap with the piston rod of a dispenser of the prior art.
Figure 2:
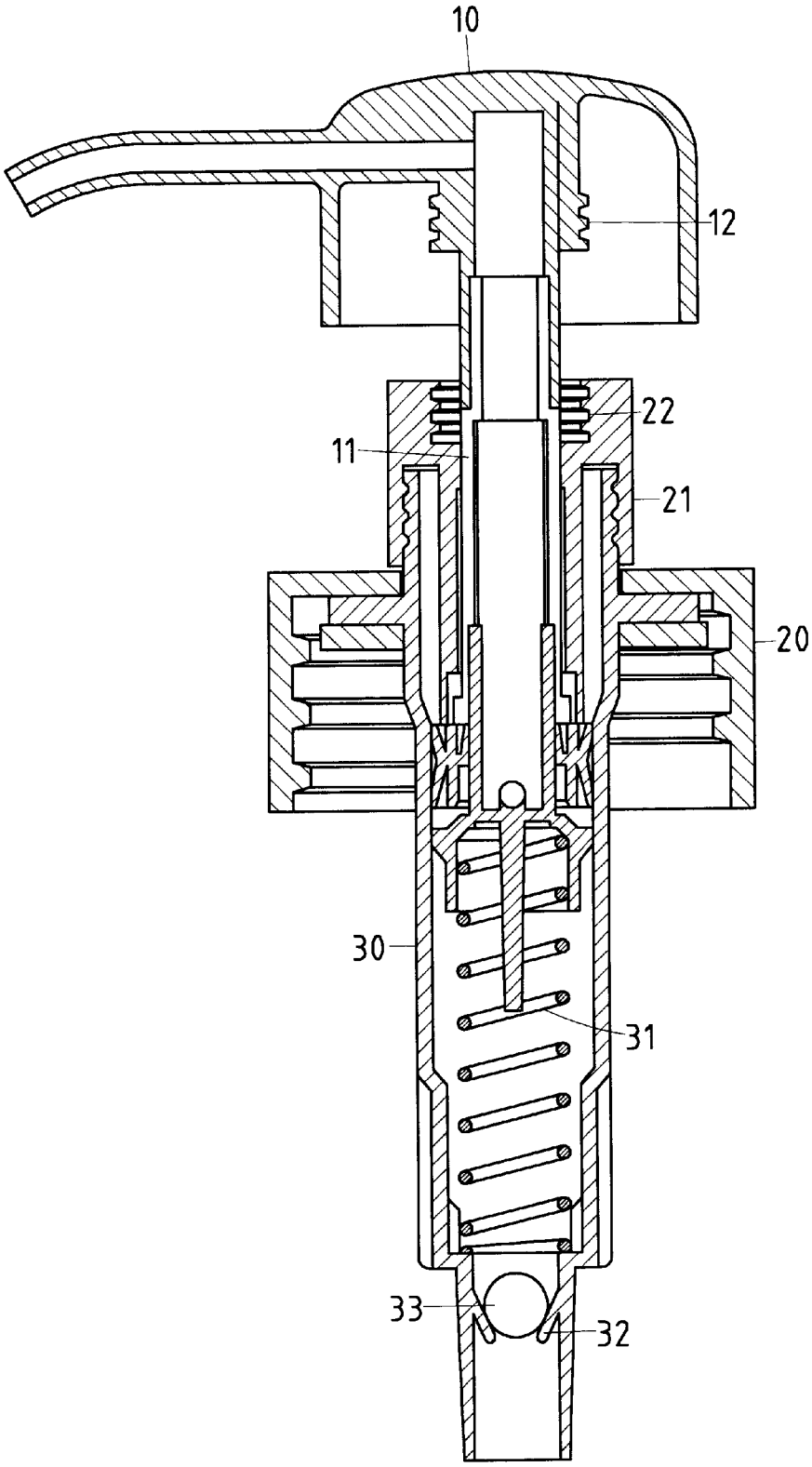
FIG.2 PRIOR ART
FIG. 2 shows a longitudinal sectional view of the disengagement of the fastening cap with the piston rod of the dispenser of the prior art.
Figure 3:
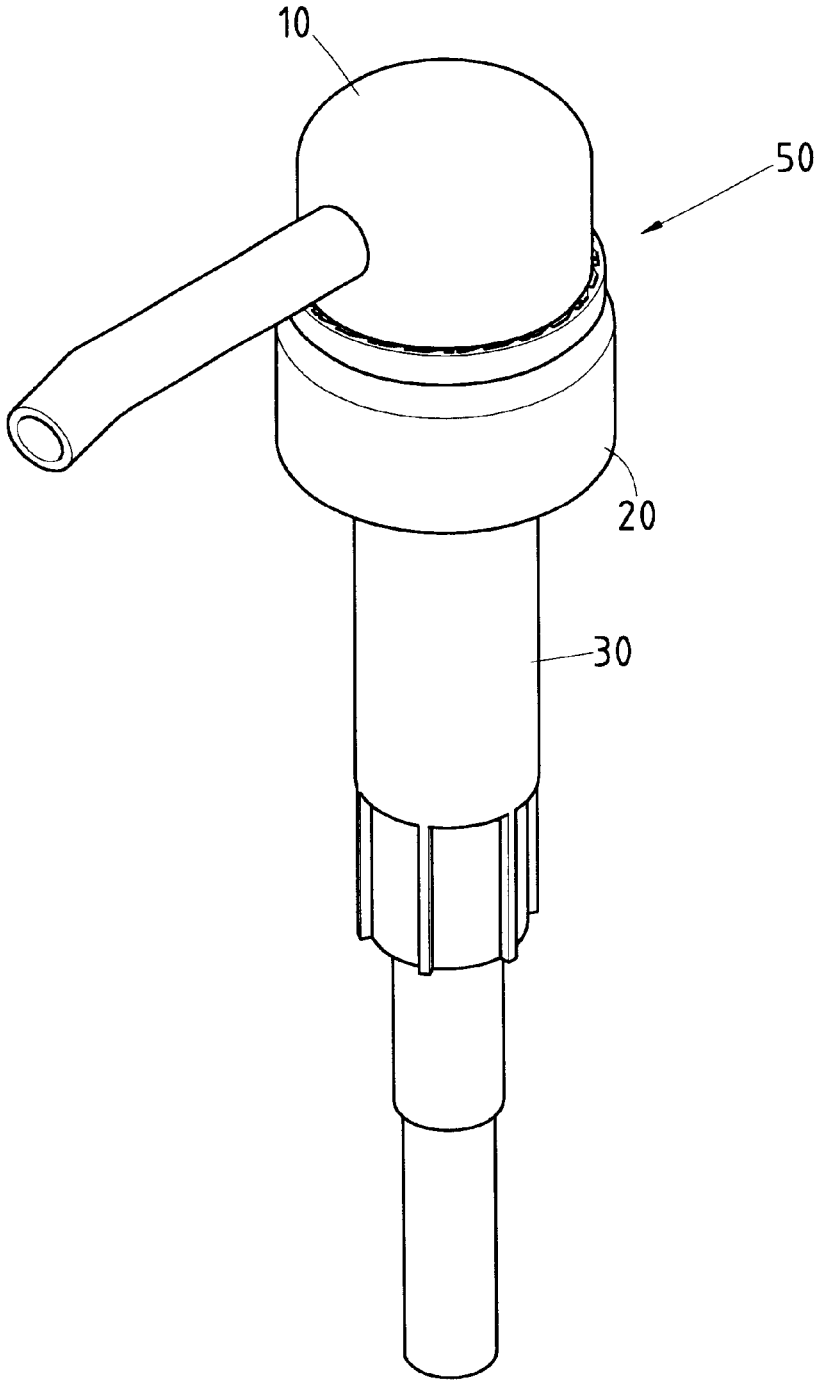
FIG. 3 shows a perspective view of the preferred embodiment of the present invention.
Figure 4:
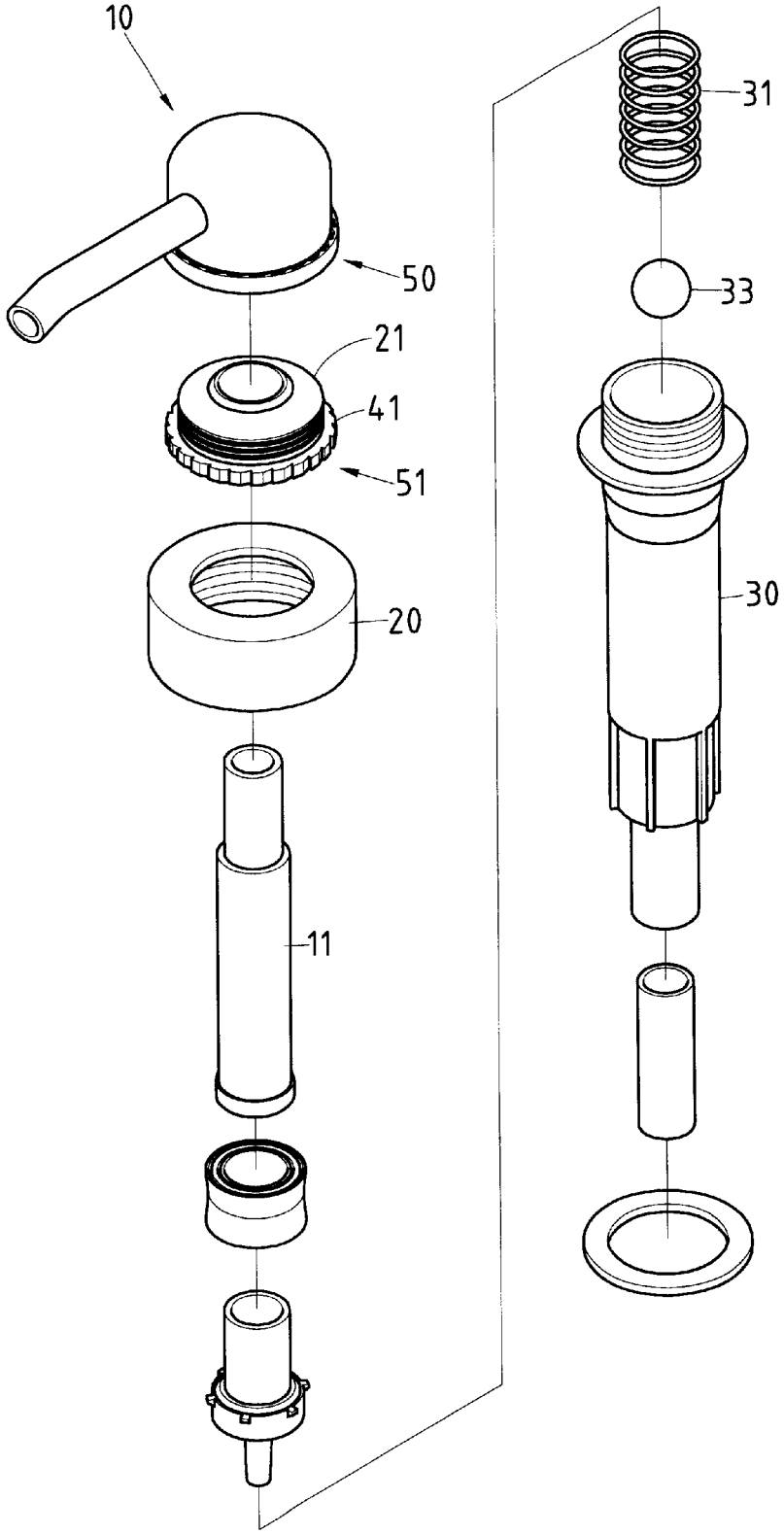
FIG. 4 shows an exploded sectional view of the preferred embodiment of the present invention.

As shown in FIGS. 3–8, a dispenser pump safety structure of the present invention comprises a pump head 10 and a locking cap 21.

The pump head 10 is fastened to the top end of a piston rod 11 which is extended into the interior of a cylindrical body 30 for holding the contents. The piston rod 11 is received in the interior of the cylindrical body 30 in conjunction with a spring 31 and a ball 33 which is received in a slot 32 of the cylindrical body 30. The piston rod 11 and the cylindrical body 30 are not the subject matter of the present invention. The cylindrical body 30 is provided at the top end with a dispenser cap 20 fastened thereto.

The pump head 10 is provided in the inner wall with inner threads 40.

Figure 6:
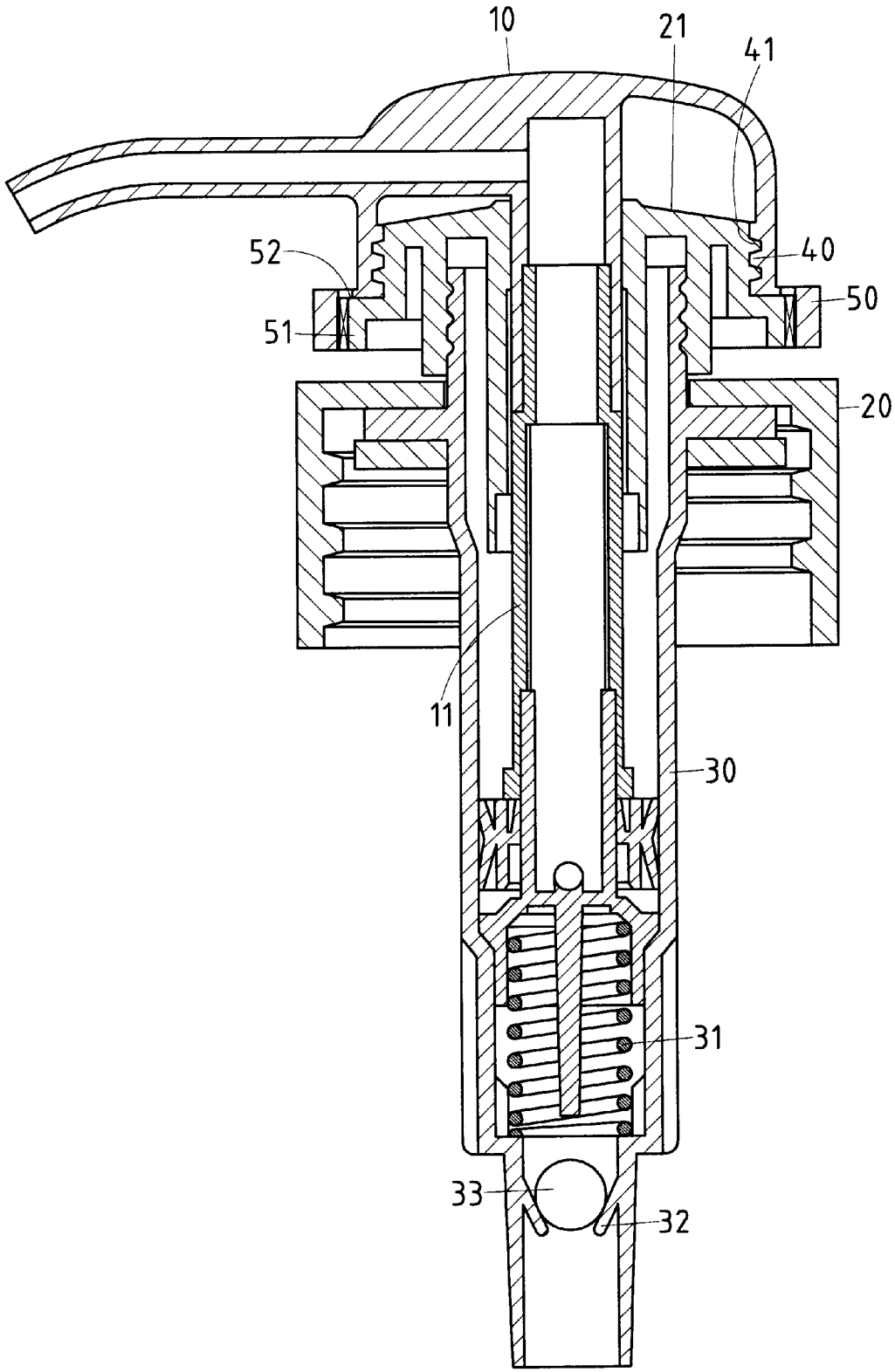
FIG. 6 shows a longitudinal sectional view of the engagement of the dispenser pump head with the locking cap of the preferred embodiment of the present invention.
Figure 7:
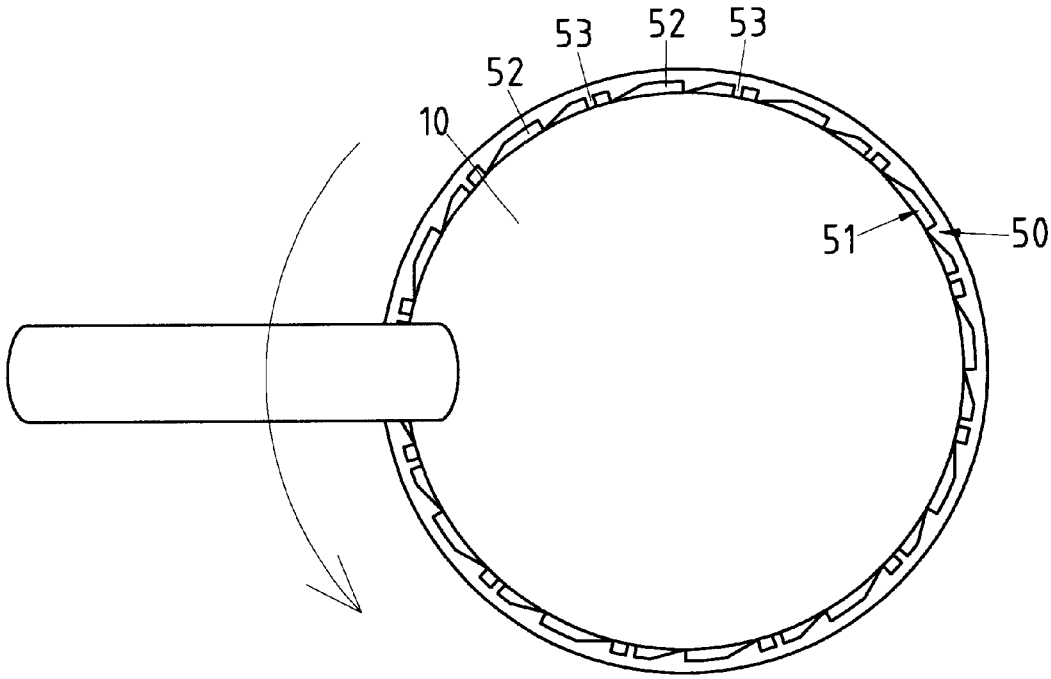
FIG. 7 shows a cross-sectional view of the preferred embodiment of the present invention in the locking state.

The locking cap 21 is located between the pump head 10 and the dispenser cap 20 and is provided in the outer wall with outer threads 41 engageable with the inner threads 40 of the pump head 10. The dispenser pump is disabled at the time when the pump head 10 is joined with the locking cap 21 such that the inner threads 40 of the pump head 10 are engaged with the outer threads 41 of the locking cap 21, as shown in FIGS. 6 and 7. In other words, the contents of the cylindrical body 30 can not be dispensed at such time when the pump head 10 is engaged with the locking cap 21.

Figure 5:
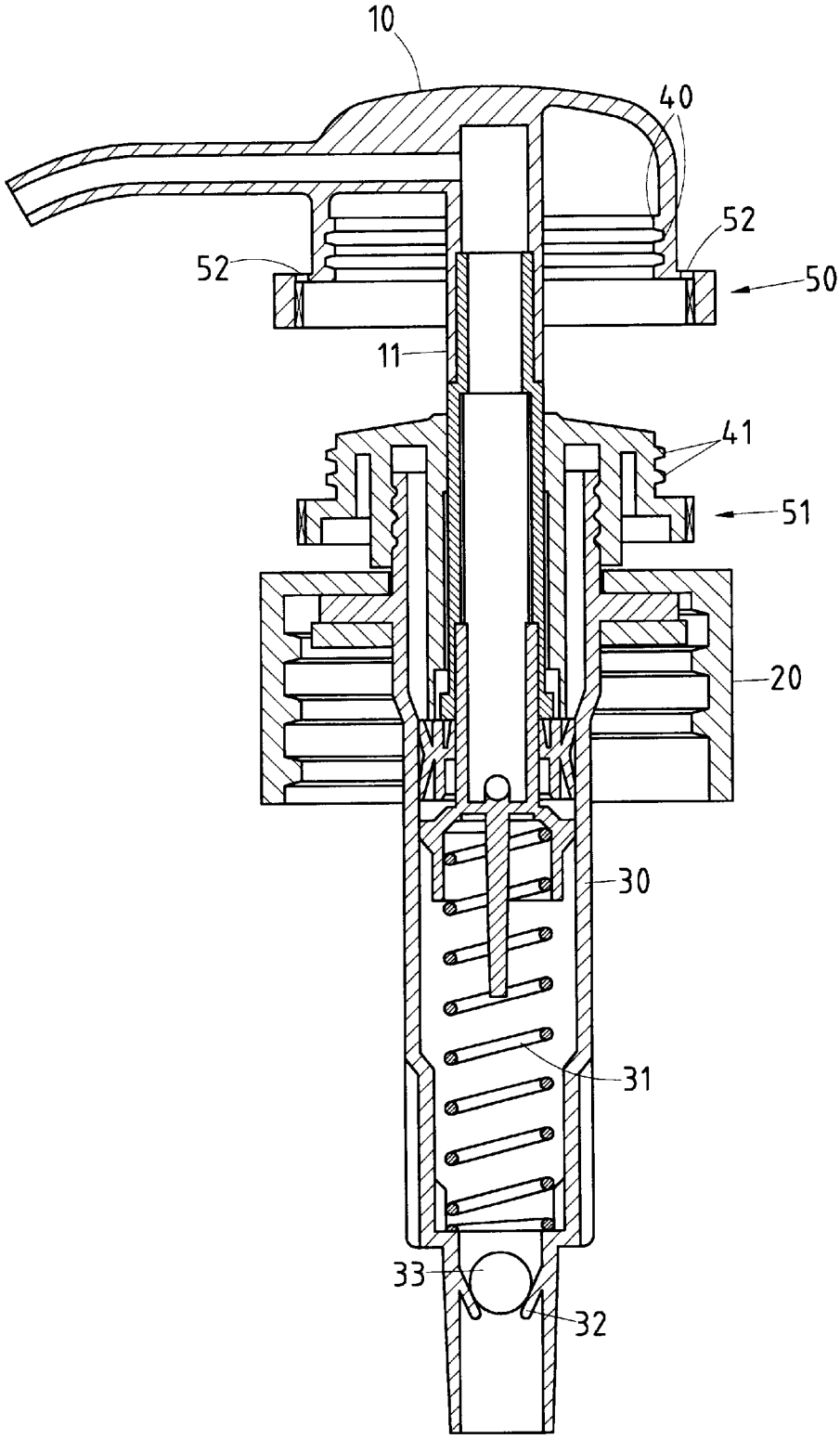
FIG. 5 shows a longitudinal sectional view of the disengagement of the dispenser pump head with the locking cap of the preferred embodiment of the present invention.
Figure 8:
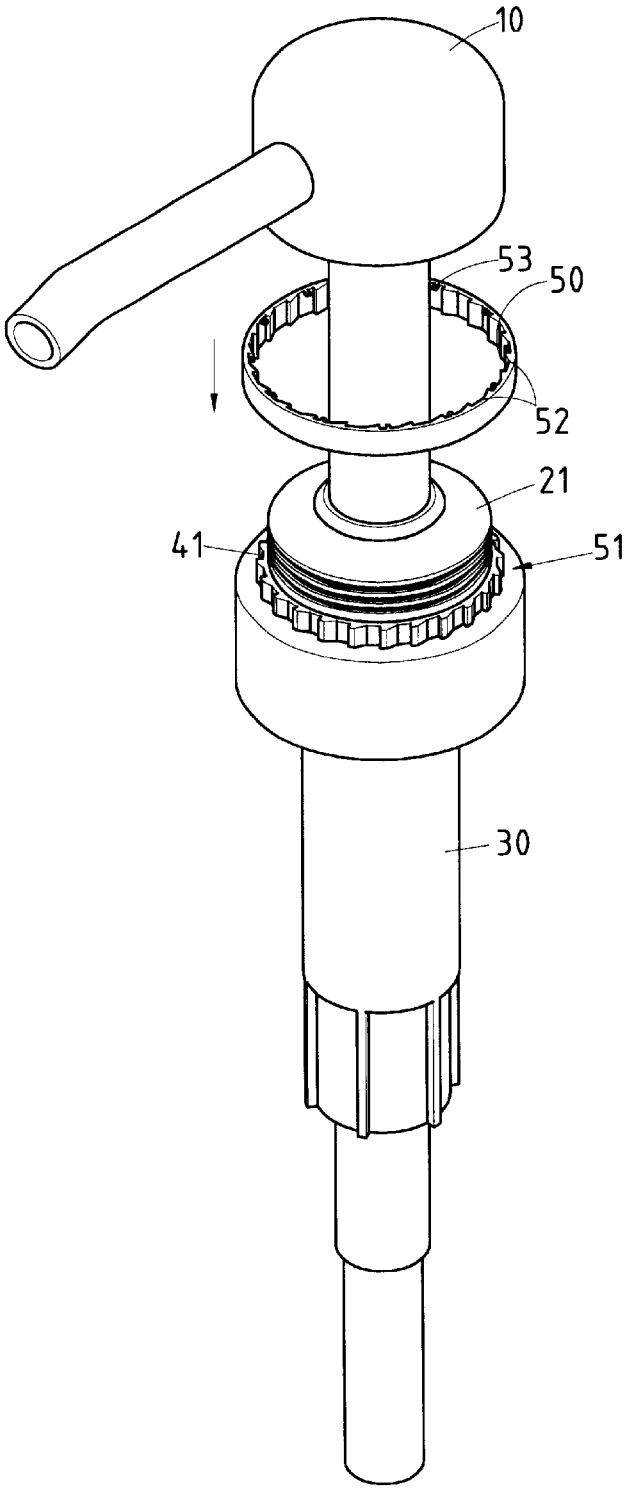
FIG. 8 shows a schematic view of the preferred embodiment of the present invention in the standby state.

The present invention is characterized by the pump head 10, which is provided with a first ratchet portion 50. The present invention is further characterized by the locking cap 21, which is provided with a second ratchet portion 51. Both the first ratchet portion 50 and the second ratchet portion 51 have teeth which are sloped in one direction. The first ratchet portion 50 is opposite to the second ratchet portion 51 in terms of the tooth slope direction. The first ratchet portion 50 or second ratchet portion 51 forms with the pump head 10 or locking cap 21 a plurality of hollow portions 52 which are arranged at intervals such that a rib 53 is located between two hollow portions 52, as shown in FIG. 7. The first ratchet portion 50 is partially fastened to the pump head 10, whereas the second ratchet portion 51 is partially fastened to the locking cap 21. As a result, both the first ratchet portion 50 and the second ratchet portion 51 can be twisted off, so as to enable the pump head 10 and the locking cap 21 to be disengaged with each other, as illustrated in FIGS. 5 and 8. The first ratchet portion 50 of the pump head 10 and the second ratchet portion 51 of the locking cap 21 serve as safety means to avert an accidental disengagement of the pump head 10 with the locking cap 21, thereby preventing the contents of the cylindrical body 30 from being dispensed accidentally or inadvertently.

The embodiment of the present invention described above is to be regarded in all respects as being illustrative and nonrestrictive. Accordingly, the present invention may be embodied in other specific forms without deviating from the spirit thereof. The present invention is therefore to be limited only by the scope of the following claim.

I claim:

1. A dispenser comprising:

a hollow cylindrical body;

a dispenser cap fastened to a top end of the hollow cylindrical body;

a piston rod extending via the dispenser cap into the hollow interior of the cylindrical body;

a pump head fastened to a top end of the piston rod and comprised of inner threads; and a locking cap disposed between the dispenser cap and the pump head and comprised of outer threads, the locking cap being joined with the pump head such that the outer threads of the locking cap are engaged with the inner threads of the pump head;

wherein said pump head is comprised of a first ratchet portion fastened thereto such that said first ratchet portion can be twisted off, and such that said first ratchet portion forms with said pump head a plurality of hollow portions and ribs, each of said ribs being located between two of said hollow portions;

wherein said locking cap is comprised of a second ratchet portion fastened thereto such that said second ratchet portion can be twisted off, and such that said second ratchet portion forms with said locking cap a plurality of hollow portions and ribs, each of said ribs being located between two of said hollow portions.

* * * * *